US012606284B2

(12) United States Patent
Takano et al.

(10) Patent No.: US 12,606,284 B2
(45) Date of Patent: Apr. 21, 2026

(54) WATERCRAFT MANEUVERING SYSTEM, AND WATERCRAFT INCLUDING THE WATERCRAFT MANEUVERING SYSTEM

(71) Applicant: YAMAHA HATSUDOKI KABUSHIKI KAISHA, Iwata (JP)

(72) Inventors: Naoju Takano, Shizuoka (JP); Makoto Ito, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 551 days.

(21) Appl. No.: 18/120,453

(22) Filed: Mar. 13, 2023

(65) Prior Publication Data

US 2023/0294805 A1 Sep. 21, 2023

(30) Foreign Application Priority Data

Mar. 15, 2022 (JP) ..... 2022-040093

(51) Int. Cl.

| | |
|---|---|
| ***B63H 25/04*** | (2006.01) |
| ***B63B 21/24*** | (2006.01) |
| ***B63B 79/40*** | (2020.01) |
| ***B63C 9/00*** | (2006.01) |

(52) U.S. Cl.

CPC ..... *B63C 9/0005* (2013.01); *B63B 21/24* (2013.01); *B63B 79/40* (2020.01); *B63H 25/04* (2013.01)

(58) Field of Classification Search

CPC ..... B63C 9/00; B63C 9/0005; B63H 25/00; B63H 25/04; B63B 79/00; B63B 79/40; B63B 21/00; B63B 21/24

USPC ..... 440/1

See application file for complete search history.

(56) References Cited

U.S. PATENT DOCUMENTS

| | | | | |
|---|---|---|---|---|
| 10,730,600 | B2 * | 8/2020 | Gonring | B63C 9/0005 |
| 11,014,642 | B2 * | 5/2021 | Gonring | B63C 9/0005 |
| 11,618,538 | B2 * | 4/2023 | Gonring | B63C 9/0005 701/21 |
| 11,718,375 | B2 * | 8/2023 | Gonring | B63C 9/0005 701/21 |
| 2020/0255104 | A1 | 8/2020 | Gonring et al. | |

* cited by examiner

*Primary Examiner* — Lars A Olson

(74) *Attorney, Agent, or Firm* — Keating & Bennett, LLP

(57) ABSTRACT

A watercraft maneuvering system includes a watercraft maneuvering input on a watercraft operable by an operator of the watercraft so as to command generation of a propulsive force, a controller on the watercraft and configured or programmed to control operation of a propulsion system of the watercraft according to the operation of the watercraft maneuvering input, and a disembarkation sensor to detect disembarkation of the operator from the watercraft. The controller is configured or programmed to perform an operation state maintaining control operation to maintain the propulsion system in a propulsive force non-generation state when the disembarkation sensor detects that the operator has disembarked from the watercraft irrespective of the operation of the watercraft maneuvering input.

9 Claims, 7 Drawing Sheets

WATERCRAFT MANEUVERING SYSTEM, AND WATERCRAFT INCLUDING THE WATERCRAFT MANEUVERING SYSTEM

CROSS REFERENCE TO RELATED APPLICATIONS

This application claims the benefit of priority to Japanese Patent Application No. 2022-040093 filed on Mar. 15, 2022. The entire contents of this application are hereby incorporated herein by reference.

BACKGROUND OF THE INVENTION

1. Field of the Invention

The present invention relates to a watercraft maneuvering system and a watercraft including the watercraft maneuvering system.

2. Description of the Related Art

US 2020/0255104A1 discloses a wireless lanyard system that detects a watercraft operator falling overboard from a watercraft by utilizing wireless communications between a transceiver provided in a helm area of the watercraft and an operator fob carried by the operator. Such an operator overboard event is detected when the operator fob does not return a response signal in response to a query signal periodically transmitted by the transceiver. In response to the detection of the operator overboard event, the engine rotation speed of the watercraft is reduced to an idling rotation speed, and the gear system of the watercraft is shifted to a neutral position such that the generation of a propulsive force is stopped.

Watercraft maneuvering operation elements, i.e., a throttle/shift lever and a joystick, are provided in the helm area, and the shift position of the gear system is changed by operating these operation elements. The wireless lanyard system is configured so as to start operating when the shift position of the gear system is brought out of the neutral position, i.e., into a forward shift position or a reverse shift position.

SUMMARY OF THE INVENTION

The inventors of preferred embodiments of the present invention described and claimed in the present application conducted an extensive study and research regarding a watercraft maneuvering system, such as the one described above, and in doing so, discovered and first recognized new unique challenges and previously unrecognized possibilities for improvements as described in greater detail below.

When the operator is spaced away from the watercraft, an occupant of the watercraft other than the operator may operate the watercraft maneuvering operation elements. This is sometimes desirable, but the operator often does not want to allow other occupants to operate the operation elements in a normal situation, particularly, when the operator is not involved in the overboard event.

Preferred embodiments of the present invention provide watercraft maneuvering systems that are each able to properly control watercraft maneuvering operations to be performed by an occupant other than a watercraft operator to permit the operator to properly manage the operation state of a watercraft propulsion system, and also provide watercraft including such watercraft maneuvering systems.

In order to overcome the previously unrecognized and unsolved challenges described above, a preferred embodiment of the present invention provides a watercraft maneuvering system including an operator fob usable by an operator of a watercraft, a watercraft maneuvering input on the watercraft and operable by the operator so as to command the generation of a propulsive force, a controller on the watercraft and configured or programmed to control operation of a propulsion system of the watercraft according to an operation of the watercraft maneuvering input, and a disembarkation sensor to detect disembarkation of the operator carrying the operator fob from the watercraft. The controller is configured or programmed to perform an operation state maintaining control operation to maintain the propulsion system in a propulsive force non-generation state when the disembarkation sensor detects that the operator carrying the operator fob has disembarked from the watercraft irrespective of the operation of the watercraft maneuvering input.

With this arrangement, the propulsion system is maintained in the propulsive force non-generation state when the operator carrying the operator fob is spaced away from the watercraft irrespective of the operation of the watercraft maneuvering input. Therefore, even if an occupant of the watercraft not carrying the operator fob operates the watercraft maneuvering input, the operation of the watercraft maneuvering input is invalidated. Thus, the operator carrying the operator fob is able to properly manage the operation state of the propulsion system, particularly the generation of the propulsive force.

The expression "the operator carrying the operator fob" means that the operator fob is with the operator and, if the operator moves, the operator fob moves together with the operator. The expression "the operator carrying the operator fob" also means that the operator possesses the operator fob, and typically that the operator carries the operator fob on his body.

In a preferred embodiment of the present invention, the propulsion system includes an engine, a propeller driven by the engine, and a clutch provided in a power transmission path between the engine and the propeller. The propulsive force non-generation state of the propulsion system preferably includes an operation state in which the clutch is in a disengaged state.

With this arrangement, the propulsion system is an engine propulsion system including an engine (internal combustion engine). When the engine is in operation, the propulsive force generation is enabled and disabled by changing the state of the clutch provided in the power transmission path. With the clutch in an engaged state, the power of the engine is transmitted to the propeller such that the propulsive force is generated. With the clutch in the disengaged state, the propeller loses power, so that the propulsive force is not generated.

An example of the clutch is a shift mechanism (typically, a gear mechanism) including a plurality of shift positions including a forward shift position, a neutral shift position, and a reverse shift position. When the shift position is the forward shift position, the propeller generates the propulsive force in a forward watercraft drive direction. When the shift position is the reverse shift position, the propeller generates the propulsive force in a reverse watercraft drive direction. When the shift position is the neutral shift position, the shift mechanism is brought into the disengaged state in which the power transmission path is cut off. Therefore, the power of the engine is not transmitted to the propeller.

A state in which the engine is in operation and the clutch is in the disengaged state is an example of the propulsive force generating state of the propulsion system that generates the propulsive force according to the operation of the watercraft maneuvering input. If the operator is present on the watercraft, the operator is able to issue a command to engage/disengage the clutch by operating the operator, thus enabling and disabling the generation of the propulsive force. When the disembarkation of the operator from the watercraft is detected, the controller maintains the clutch in the disengaged state even if the operator is operated. Thus, the propulsion system is maintained in the propulsive force non-generation state.

In a preferred embodiment of the present invention, the disembarkation sensor includes a communicator to wirelessly communicate with the operator fob, and to detect whether or not the operator has disembarked from the watercraft based on a state of communication between the communicator and the operator fob.

With this arrangement, the disembarkation of the operator from the watercraft is detected based on the state of the wireless communication between the operator fob and the communicator without any physical connection between the operator fob and the watercraft. Therefore, the operator is able to leave the watercraft while carrying the operator fob. Even in this situation, the operator is able to properly manage the operation state of the propulsion system (particularly, the generation of the propulsive force).

In a preferred embodiment of the present invention, the watercraft maneuvering system further includes an overboard sensor to detect an operator overboard event when the operator falls overboard from the watercraft. If the overboard sensor detects the operator overboard event, the controller is configured or programmed not to perform the operation state maintaining control operation but to perform a propulsive force nullifying control operation to nullify the propulsive force of the propulsion system.

With this arrangement, the operation state maintaining control operation is not performed but the propulsive force nullifying control operation is performed if the operator overboard event is detected by the overboard sensor. Therefore, the propulsion system is brought into the propulsive force non-generation state if the operator falls overboard. This substantially prevents the watercraft from moving away from the operator overboard.

The propulsive force nullifying control operation may be performed by stopping the engine and/or disengaging the clutch in the engine propulsion system. Further, the propulsive force nullifying control operation may be performed by stopping an electric motor in an electric propulsion system.

In a preferred embodiment of the present invention, the disembarkation sensor and the overboard sensor may share the communicator that wirelessly communicates with the operator fob, and may be operable to distinguish between the operator overboard event and the disembarkation of the operator from the watercraft based on the state of the communication between the communicator and the operator fob. With this arrangement, the communicator for wireless communication with the operator fob is able to be used for the disembarkation sensor and for the overboard sensor.

In a preferred embodiment of the present invention, the watercraft maneuvering system further includes a cancellation switch to cancel the operation state maintaining control operation. With this arrangement, the operation state maintaining control operation is able to be cancelled by operating the cancellation switch and, therefore, an occupant not carrying the operator fob is permitted to perform the watercraft maneuvering operation as required. Thus, the watercraft maneuvering system allows an occupant other than the operator to perform the watercraft maneuvering operation as required, while permitting the operator to properly manage the operation state of the propulsion system (particularly, the generation of the propulsive force).

Another preferred embodiment of the present invention provides a watercraft maneuvering system including a watercraft maneuvering input on a watercraft and operable by an operator of the watercraft to command generation of a propulsive force, a controller provided on the watercraft and configured or programmed to control operation of a propulsion system of the watercraft according to the operation of the watercraft maneuvering input, and a disembarkation sensor to detect disembarkation of the operator from the watercraft. The controller is configured or programmed to perform an operation state maintaining control operation to maintain the propulsion system in a propulsive force non-generation state when the disembarkation sensor detects that the operator has disembarked from the watercraft irrespective of the operation of the watercraft maneuvering input.

With this arrangement, the propulsion system is maintained in the propulsive force non-generation state when the operator is spaced away from the watercraft irrespective of the operation of the watercraft maneuvering input. Therefore, even if an occupant of the watercraft other than the operator operates the watercraft maneuvering input, the operation of the watercraft maneuvering input is invalidated. Thus, the operator is able to properly manage the operation state of the propulsion system (particularly, the generation of the propulsive force).

Another further preferred embodiment of the present invention provides a watercraft including a hull, a propulsion system provided on the hull, and a watercraft maneuvering system having any of the above-described features.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
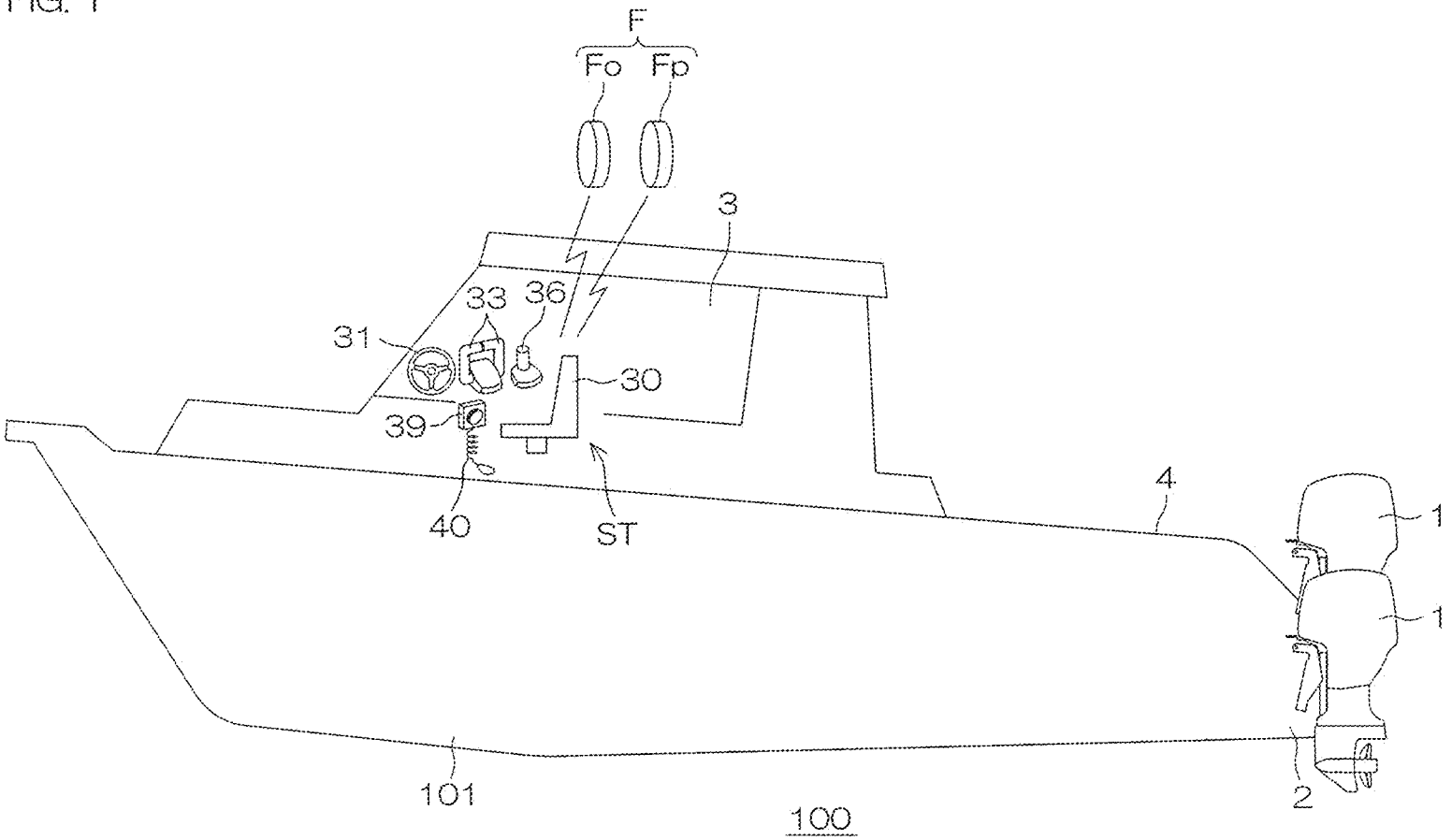
FIG. 1 is a diagram showing the structure of a watercraft according to a preferred embodiment of the present invention by way of example.

FIG. 1 is a diagram showing the structure of a watercraft 100 according to a preferred embodiment of the present invention by way of example. The watercraft 100 includes a hull 101 and outboard motors 1 provided as exemplary propulsion systems on the hull 101. In this example, two outboard motors 1 are attached to the stern 2 of the hull 101, and arranged side by side transversely of the hull 101.

The hull 101 includes a cabin 3 defined by an outer shell to provide a living space, and a deck 4 provided behind the cabin 3. The watercraft 100 includes a watercraft maneuvering station ST (watercraft maneuvering area). In FIG. 1, the watercraft 100 is illustrated as including a single watercraft maneuvering station ST provided in the cabin 3 by way of example. Alternatively, the watercraft 100 may include a plurality of watercraft maneuvering stations provided on the hull 101.

In the present preferred embodiment, a steering wheel 31, acceleration levers 33, and a joystick 36 are provided in the watercraft maneuvering station ST. The steering wheel 31 is operable to steer the watercraft 100, and the acceleration levers 33 are operable to adjust the propulsive force. The joystick 36 is operable to steer the watercraft 100 and to adjust the propulsive force. A watercraft maneuvering operation is generally performed by operating the steering wheel 31 and the acceleration levers 33. The joystick 36 is mainly used for the watercraft maneuvering operation when the azimuth and/or the position of the watercraft 100 are finely adjusted during docking and undocking, and during berthing at a fishing spot. Of course, the watercraft maneuvering operation with the use of the joystick 36 is not limited to that for the adjustment of the azimuth and/or the position of the watercraft 100 during low-speed traveling, and the joystick 36 may be used for the watercraft maneuvering operation during intermediate-speed and high-speed cruising. The watercraft maneuvering station ST is an area (i.e., a watercraft maneuvering area) in which a watercraft operator performs the watercraft maneuvering operation. In the example of FIG. 1, the watercraft maneuvering station ST includes a driver seat 30 on which the operator sits. In some cases, no driver seat 30 is provided in the watercraft maneuvering station ST.

A lanyard switch 39 is provided in the watercraft maneuvering station ST. The lanyard switch 39 is connected to one end of the lanyard cable 40. The other end of the lanyard cable 40 is connected to the operator. If the operator happens to fall overboard, the lanyard switch 39 is operated via the lanyard cable 40 to nullify the propulsive force of the watercraft 100.

The occupants of the watercraft 100 may each carry a fob F. Typically, the fob F is carried on the occupant's body. The fob F may be wearable, for example, on a wrist, a neck, a belt, or clothing. The occupants are each categorized as the operator or a passenger. The operator fob Fo is to be carried by the operator and a passenger fob Fp is to be carried by the passenger. In the present preferred embodiment, the fobs F are electronic devices each having at least a transmitter function.

Figure 2:
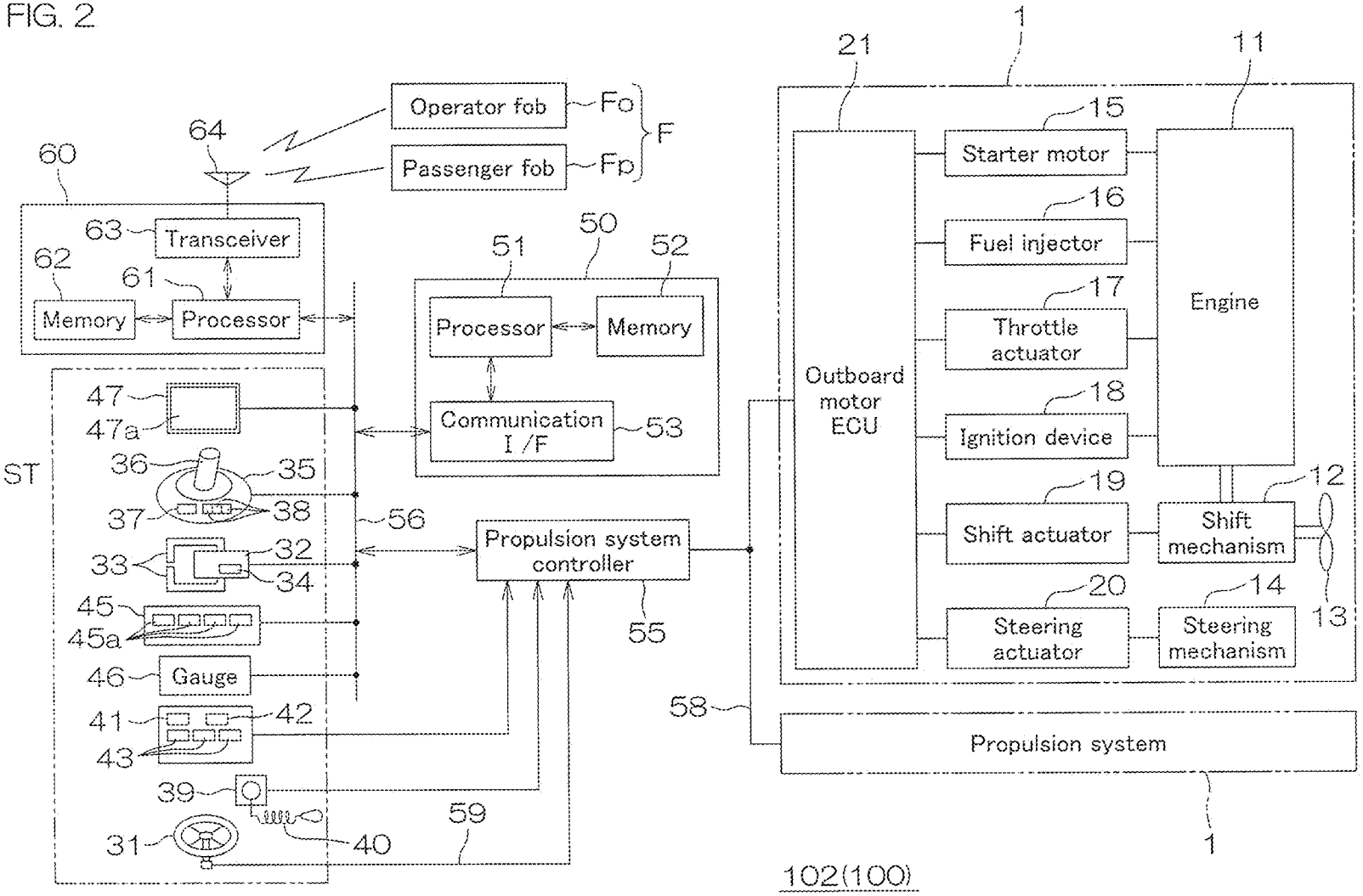
FIG. 2 is a block diagram showing the configuration of a watercraft maneuvering system by way of example.

FIG. 2 is a block diagram showing the configuration of a watercraft maneuvering system 102 provided in the watercraft 100 by way of example. The watercraft maneuvering system 102 includes the watercraft maneuvering station ST and the fobs F described above. In the present preferred embodiment, the watercraft maneuvering station ST includes the steering wheel 31, a remote control unit 32, and a joystick unit 35.

Figure 3:
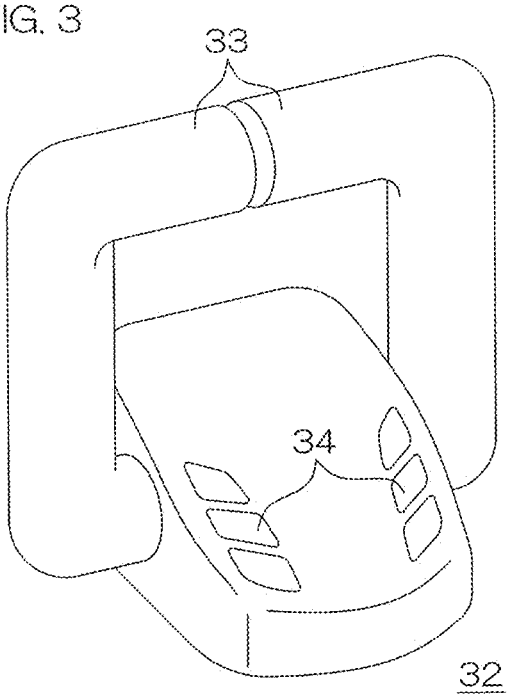
FIG. 3 is a perspective view showing the structure of a remote control unit by way of example.

The remote control unit 32 includes two acceleration levers 33 respectively corresponding to the two outboard motors 1, as shown in the exemplary structural diagram of FIG. 3. The remote control unit 32 includes neutral hold buttons 34. The neutral hold buttons 34 are operated to hold the shift positions of the outboard motors 1 in neutral shift positions and to cancel this shift position holding state. More specifically, if the neutral hold buttons 34 are operated when the shift positions of the outboard motors 1 are the neutral shift positions, the outboard motors 1 are brought into a neutral shift position holding state and, even if the acceleration levers 33 are operated, the shift positions are held in the neutral shift positions. If the neutral hold buttons 34 are operated when the outboard motors 1 are in the neutral shift position holding state, the outboard motors 1 are brought out of the neutral shift position holding state. The neutral hold buttons 34 are examples of the cancellation switch operable to cancel the operation state maintaining control operation (neutral holding control operation).

Figure 4:
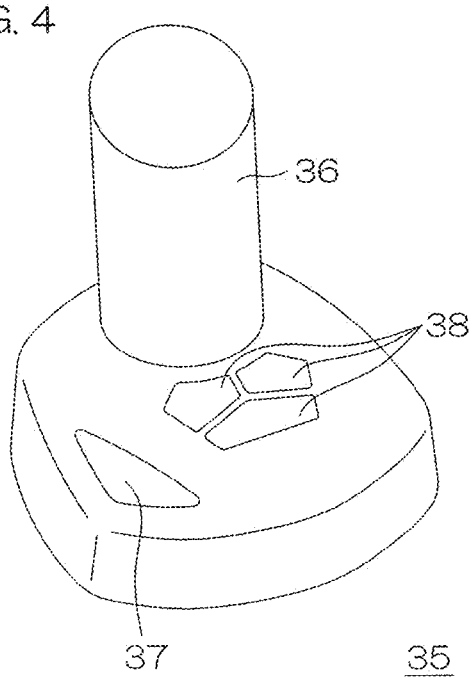
FIG. 4 is a perspective view showing the structure of a joystick unit by way of example.

The joystick unit 35 includes the joystick 36, which is able to be inclined anteroposteriorly and laterally (i.e., in all 360-degree directions), and is able to be turned (twisted) about its axis, as shown in the exemplary structural diagram of FIG. 4. In this example, the joystick unit 35 further includes a joystick button 37. The joystick button 37 is operable by the operator when a control mode (watercraft maneuvering operation mode) utilizing the joystick 36, i.e., a joystick mode, is to be selected. In this example, the joystick unit 35 further includes mode setting buttons 38 operable by the operator to select position/azimuth holding system control modes (examples of a control mode for an automatic watercraft maneuvering operation). More specifically, the mode setting buttons 38 include a mode setting button for a fixed point holding mode (Stay Point™) in which the position and the bow azimuth of the watercraft 100 are maintained, a mode setting button for a position holding mode (Fish Point™) in which the position of the watercraft 100 is maintained but the bow azimuth is not maintained, and a mode setting button for an azimuth holding mode (Drift Point™) in which the bow azimuth is maintained but the watercraft position is not maintained.

Referring again to FIG. 2, the watercraft maneuvering station ST additionally includes a main switch 41, an all-switch 42, separate switches 43, an application panel 45, a gauge 46, a display 47 and the like. The main switch 41 is operable by the operator to turn on and off power supply to the watercraft maneuvering system 102. The all-switch 42 is operable by the operator to start or stop all the outboard motors 1. The separate switches 43 are operable by the operator to individually start or stop the respective outboard motors 1, and the number of the separate switches 43 corresponds to the number of the outboard motors 1. The application panel 45 includes a plurality of switches operable to start application programs, for example, for the automatic watercraft maneuvering operation. Specifically, the application panel 45 may include mode setting switches **45*a* operable to start course holding system (autopilot system) control modes (other examples of the control mode for the automatic watercraft maneuvering operation). Specifically, the course holding system control modes may include at least one of a bow holding mode (Heading Hold) in which the bow azimuth is maintained during forward traveling, a straight travel holding mode (Course Hold) in which the bow azimuth is maintained and a straight course is maintained during forward traveling, a checkpoint following mode (Track Point) in which a course passing through predetermined checkpoints is followed, and a pattern traveling mode (Pattern Steer) in which a predetermined course pattern is followed. Examples of the course pattern to be followed in the pattern traveling mode include a zig-zag pattern and a spiral pattern. The gauge 46 is an instrument which displays the operation states of the respective outboard motors 1. The display 47 displays various information. In the present preferred embodiment, the display 47 is a multifunctional display including a touch panel 47***a* provided as an exemplary input device on its surface, thus serving as a man-machine interface.

The watercraft maneuvering system 102 includes a watercraft maneuvering controller 50 for overall system control, and a propulsion system controller 55 to generate command signals to be provided to the outboard motors 1. The watercraft maneuvering controller 50 and the propulsion system controller 55 are connected to each other via an onboard network 56 in a communicable manner. The onboard network 56 is typically a CAN (Control Area Network).

The remote control unit 32 and the joystick unit 35 are connected to the onboard network 56. The application panel 45, the gauge 46, and the display 47 are also connected to the onboard network 56. The steering wheel 31 is connected to the propulsion system controller 55. Specifically, the operation angle signal of the steering wheel 31 is inputted to the propulsion system controller 55 via a steering signal line 59. Further, the main switch 41 is connected to the propulsion system controller 55 to input a power on/off command signal to the propulsion system controller 55. Further, the all-switch 42 and the separate switches 43 are connected to the propulsion system controller 55 to input a propulsion system starting command signal and/or a propulsion system stopping command signal to the propulsion system controller 55.

The propulsion system controller 55 is connected to outboard motor ECUs 21 as controllers of the respective outboard motors 1 (electronic control units, outboard motor controllers) via control signal lines 58. The propulsion system controller 55 transmits a steering command, a propulsive force command and the like to the outboard motors 1. In the present preferred embodiment, the propulsive force command includes a shift command which commands the shift positions of the outboard motors 1, and an output command which commands the outputs (the magnitudes of the propulsive forces) of the outboard motors 1. Further, the propulsion system controller 55 receives various detection signals from the outboard motor ECUs 21 of the respective outboard motors 1. The detection signals to be received preferably include signals indicating the states of the respective outboard motors 1, particularly shift position signals indicating the shift positions of the respective outboard motors 1. The signals indicating the states of the respective outboard motors 1 to be received from the outboard motor ECUs 21 by the propulsion system controller 55 may include signals indicating whether or not the engines 11 of the respective outboard motors 1 are driven (in operation), e.g., engine rotation speed signals indicating the engine rotation speeds.

The outboard motors 1 may each be an engine outboard motor or an electric outboard motor. In FIG. 2, the engine outboard motors are shown by way of example. The outboard motors 1 each include the outboard motor ECU 21, the engine 11, a shift mechanism 12, a propeller 13, a steering mechanism 14 and the like. Power generated by the engine 11 is transmitted to the propeller 13 via the shift mechanism 12. The steering mechanism 14 laterally changes the direction of the propulsive force generated by the outboard motor 1 and turns the body of the outboard motor 1 leftward and rightward with respect to the hull 101 (see FIG. 1). The shift mechanism 12 selects the shift position from a forward shift position, a reverse shift position, and a neutral shift position. With the forward shift position selected, the propeller 13 is rotated in a forward rotation direction by the transmission of the rotation of the engine 11. With the reverse shift position selected, the propeller 13 is rotated in a reverse rotation direction by the transmission of the rotation of the engine 11. With the neutral shift position selected, the transmission of the power between the engine 11 and the propeller 13 is interrupted.

The outboard motors 1 each further include a starter motor 15, a fuel injector 16, a throttle actuator 17, an ignition device 18, a shift actuator 19, a steering actuator 20 and the like, which are controlled by the outboard motor ECU 21. The starter motor 15 is an electric motor which starts the engine 11. The fuel injector 16 injects a fuel to be combusted in the engine 11. The throttle actuator 17 is an electric actuator (typically including an electric motor) which actuates the throttle valve of the engine 11. The ignition device 18 ignites a mixed gas in the combustion chamber of the engine 11, and typically includes an ignition plug and an ignition coil. The shift actuator 19 actuates the shift mechanism 12. The steering actuator 20 is a drive source for the steering mechanism 14, and typically includes an electric motor. The steering actuator 20 may include a hydraulic device of an electric pump type.

The watercraft maneuvering controller 50 includes a processor 51 (arithmetic unit), a memory 52, a communication interface 53 and the like. The watercraft maneuvering controller 50 functions as various functional units by executing a program stored in the memory 52. Various data is stored in the memory 52. The onboard network 56 is connected to the communication interface 53. Thus, the watercraft maneuvering controller 50 is able to communicate with the propulsion system controller 55. Further, the watercraft maneuvering controller 50 is able to communicate with the remote control unit 32 and the joystick unit 35. The watercraft maneuvering controller 50 communicates with the gauge 46 via the onboard network 56 to transmit display data to the gauge 46. Further, the watercraft maneuvering controller 50 communicates with the display 47 via the onboard network 56 to receive an input signal from the touch panel 47*a* and to transmit a display command signal to the display 47.

As described above, the lanyard switch 39 is provided in the watercraft maneuvering station ST. The lanyard switch 39 is connected to the propulsion system controller 55. If the lanyard switch 39 is operated, the propulsion system controller 55 disables the outboard motors 1 from generating the propulsive forces. Typically, the lanyard switch 39 is a kill switch which commands the stop of the engines 11 of the outboard motors 1. In this case, if the operator connected to the lanyard cable 40 happens to fall overboard, the lanyard switch 39 is operated to stop the engines 11. The lanyard switch 39 may be connected directly to the outboard motor ECUs 21 not via the propulsion system controller 55.

The watercraft maneuvering system 102 further includes a communication unit 60 which communicates with the fobs F. The communication unit 60 is connected to the watercraft maneuvering controller 50 via the onboard network 56. As described above, the fobs F include the operator fob Fo to be carried by the operator, and the passenger fob Fp to be carried by the passenger. The communication unit 60 includes a processor 61, a memory 62, and a transceiver 63. For example, the communication unit 60 transmits a query signal to all the fobs F at a predetermined time interval (e.g., at an interval of 1 second). The fobs F each receive the query signal, and respectively output response signals. The response signals are received by the communication unit 60. The response signals outputted from the fobs F respectively include IDs (identification information) for identification of the fobs F. Thus, the communication unit 60 is able to identify the response signals outputted from the respective fobs F.

The IDs of the fobs F to be carried by the occupants are preliminarily registered in the memory 62 of the communication unit 60. The processor 61 of the communication unit 60 compares the IDs received from the respective fobs F by the transceiver 63 (hereinafter referred to as "reception IDs") with the IDs registered in the memory 62 (hereinafter referred to as "registration IDs"). Based on the results of the comparison, the processor 61 checks whether or not all the reception IDs corresponding to the registration IDs are received. Based on the check result, the processor 61 determines whether or not an overboard event has occurred. If any of the reception IDs corresponding to the registration IDs is absent, there is a possibility that the overboard event has occurred. Therefore, the processor 61 transmits overboard information indicating the occurrence of the overboard event to the watercraft maneuvering controller 50. The overboard information includes, for example, a registration ID corresponding to the absent reception ID. The ID of the operator fob Fo and the ID of the passenger fob Fp are able to be registered in the memory 62 in a distinguishable manner. Therefore, the processor 61 is able to distinguish an operator overboard event from a passenger overboard event, and the overboard information can include information distinguishably indicating the operator overboard event or the passenger overboard event. In the present preferred embodiment, the communication unit 60 thus functions as the overboard sensor. A reference character 64 denotes the antenna of the transceiver 63.

In the present preferred embodiment, the communication unit 60 further functions as a disembarkation sensor which detects that the operator is spaced away from the watercraft 100, i.e., which detects the disembarkation of the operator from the watercraft 100. Specifically, at least the antenna 64 of the communication unit 60 is located in the watercraft maneuvering station ST, and the communication unit 60 is configured to determine a distance between the watercraft maneuvering station ST and the operator fob Fo based on a signal received from the operator fob Fo. For example, the processor 61 performs a distance determination process to determine whether or not the distance between the watercraft maneuvering station ST and the operator fob Fo is greater than a predetermined threshold based on the intensity of the signal received from the operator fob Fo by the transceiver 63. If the distance is greater than the predetermined threshold, the processor 61 determines that the operator is spaced away from the watercraft maneuvering station ST, i.e., that the operator has disembarked from the watercraft 100, and transmits disembarkation information to the watercraft maneuvering controller 50. The processor 61 may detect the disembarkation of the operator when a situation in which the distance is greater than the predetermined threshold lasts for longer than a predetermined period of time. The signal to be used for the determination of the distance may be the response signal for the detection of the overboard event or may be a different signal dedicated for the detection of the distance.

Figure 5:
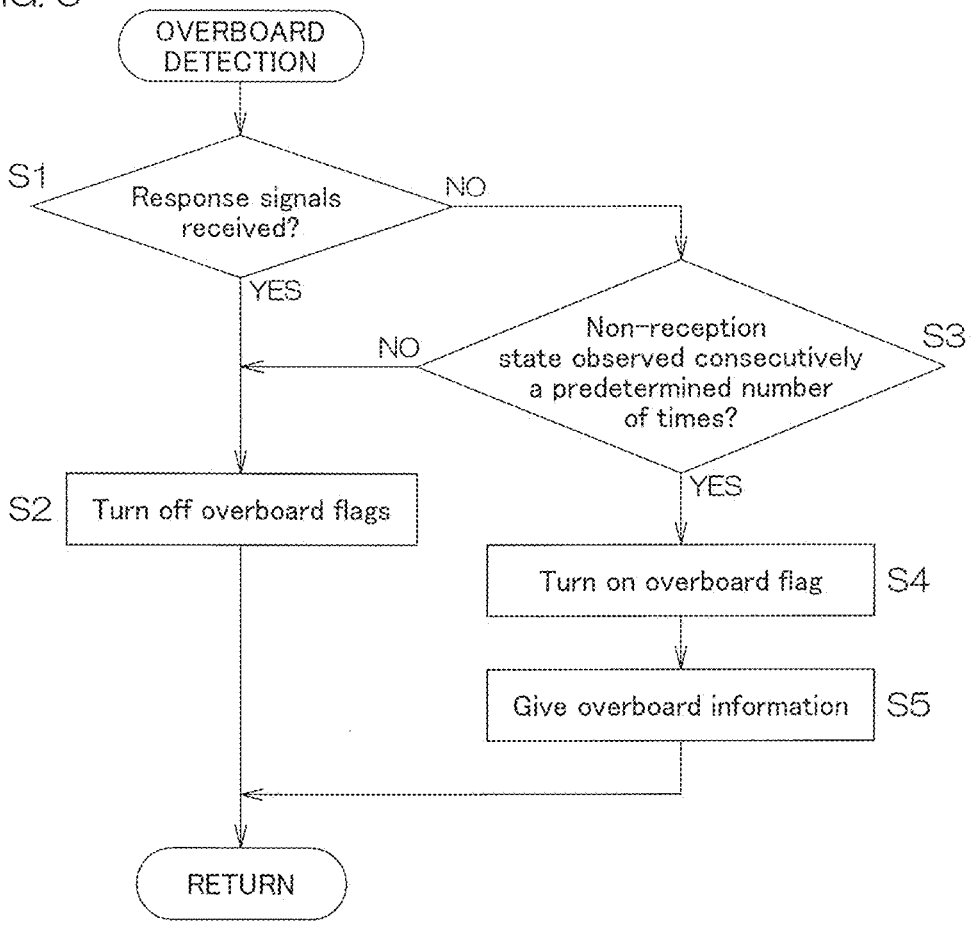
FIG. 5 is a flowchart showing an overboard detection function of a communication unit by way of example.

FIG. 5 is a flowchart showing the overboard detection function of the communication unit 60 (the function as the overboard sensor) by way of example. The processor 61 of the communication unit 60 periodically transmits the query signal to all the fobs F corresponding to the registration IDs, and performs a process shown in FIG. 5 every time it transmits the query signal. The processor 61 determines whether or not response signals are received from all the fobs F (Step S1). If the response signals are received from all the fobs F (YES in Step S1), the processor 61 turns off overboard flags for all the fobs F (Step S2), and records in the memory 62 that none of the occupants carrying the fobs F are overboard. If no response signal is received from a specific one of the fobs F (NO in Step S1), the processor 61 determines whether the non-reception state of the specific fob F is observed consecutively a predetermined number of times (Step S3). If the non-reception state of the specific fob F is not observed consecutively the predetermined number of times (NO in Step S3), the processor 61 turns off all the overboard flags (Step S2). If the non-reception state of the specific fob F is observed consecutively the predetermined number of times (YES in Step S3), the processor 61 turns on an overboard flag for the specific fob F (Step S4), and records in the memory 62 that an occupant carrying the specific fob F is overboard. Further, the processor 61 transmits the overboard information to the watercraft maneuvering controller 50 (Step S5). As described above, the overboard information includes the registration ID of the specific fob F and the fob type information indicating whether the specific fob F is the operator fob Fo or the passenger fob Fp.

The reach range of the query signal to be transmitted toward the fobs F by the communication unit 60 and the reach range of the response signal to be transmitted toward the communication unit 60 by each of the fobs F are preferably set so that the communication unit 60 is able to communicate with the fobs F when the fobs F are present on the watercraft 100. Thus, the overboard flags for the fobs F present on the watercraft 100 are able to be turned off.

Figure 6:
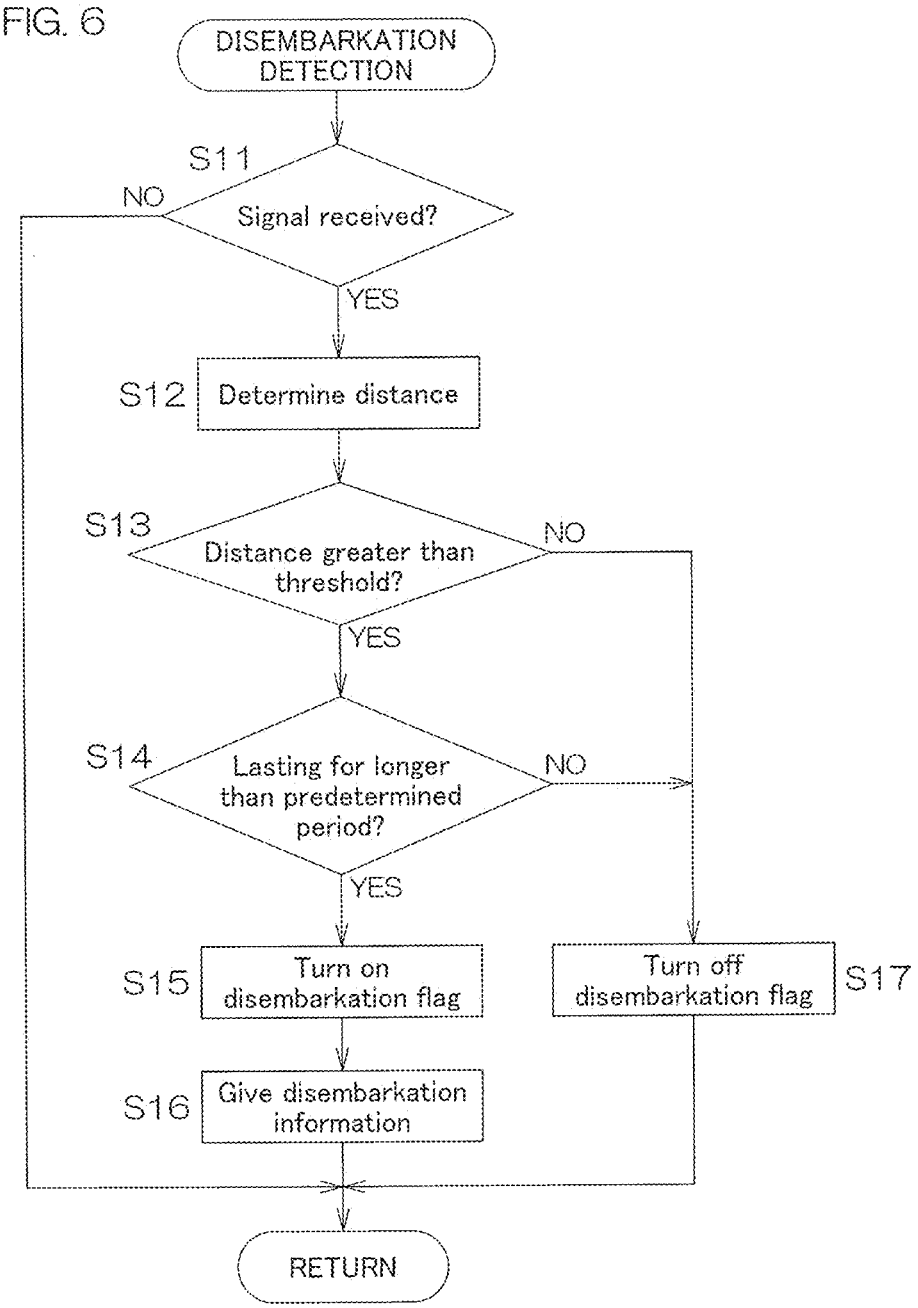
FIG. 6 is a flowchart showing a disembarkation detection function of the communication unit by way of example.

FIG. 6 is a flowchart showing the disembarkation detection function of the communication unit 60 (the function as the disembarkation sensor) by way of example. The operator fob Fo periodically transmits a distance detection signal, which is in turn received by the transceiver 63 of the communication unit 60 (Step S11). The response signal for the overboard detection may double as the distance detection signal. The transceiver 63 provides information of the intensity of the received signal to the processor 61. The processor 61 determines the distance between the communication unit 60 (i.e., the watercraft maneuvering station ST) and the operator fob Fo based on the signal intensity information (Step S12). The processor 61 determines whether or not the distance thus determined is greater than the predetermined threshold (Step S13). If the distance is not greater than the predetermined threshold (NO in Step S13), the processor 61 turns off a disembarkation flag (Step S17) and records, in the memory 62, information indicating that the operator is not spaced away from the watercraft 100. If the determined distance is greater than the predetermined threshold (YES in Step S13), on the other hand, the processor 61 further determines whether or not this situation (in which the distance is greater than the predetermined threshold) lasts for longer than the predetermined period of time (Step S14). If this determination is positive, the processor 61 turns on the disembarkation flag (Step S15) and records, in the memory 62, information indicating that the operator is spaced away from the watercraft 100. The processor 61 further transmits the disembarkation information to the watercraft maneuvering controller 50 (Step S16). If the determination in either of Step S13 and Step S14 is negative, the processor 61 turns off the disembarkation flag (Step S17).

The reach range of the distance detection signal is preferably set sufficiently long so that the distance detection signal is able to reach the communication unit 60 even if the operator fob Fo is spaced away from the watercraft 100. Thus, the communication unit 60 is able to reliably detect that the operator has left the watercraft 100. The predetermined threshold and/or the predetermined period described above are preferably properly set so that the operator is able to properly manage the operation states of the outboard motors 1.

If the operator carrying the operator fob Fo falls overboard, the response signal is lost. If the operator carrying the operator fob Fo leaves the watercraft 100, the intensity of the response signal from the operator fob Fo is reduced, but it is rare that the response signal cannot be received. Therefore, the overboard event and the disembarkation are able to be distinguished from each other by monitoring the response signal.

If the operator carrying the operator fob Fo leaves the watercraft 100 (disembarks from the watercraft 100) to move far away from the watercraft 100, both the overboard flag and the disembarkation flag may be turned on. In this case, the overboard information may be erroneously given. This may be avoided, for example, by monitoring the intensity of the response signal from the operator fob Fo and preventing the overboard flag from being turned on (so as not to determine that the overboard event occurs) if the response signal is lost after its intensity gradually decreases. If the operator carrying the operator fob Fo falls overboard, the response signal is generally suddenly lost. Therefore, when the intensity of the response signal gradually decreases, it may be determined that the overboard event does not occur. Further, the overboard event and the disembarkation are able to be detected in a distinguishable manner by utilizing different signals (different radio waves) for the detection of the overboard event and for the detection of the disembarkation.

Figure 7:
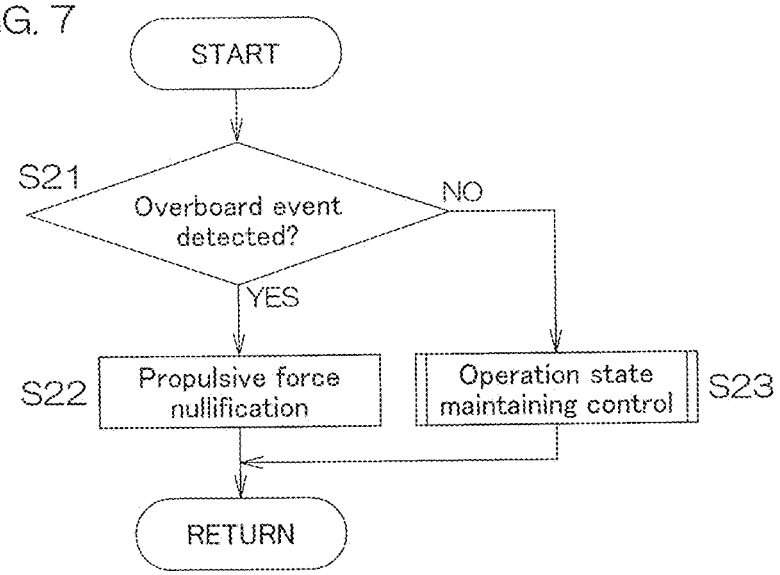
FIG. 7 is a flowchart showing an exemplary process to be performed by a watercraft maneuvering controller in relation to overboard information provided by the communication unit.

FIG. 7 is a flowchart showing an exemplary process to be performed by the watercraft maneuvering controller 50 in relation to the overboard information provided by the communication unit 60. The watercraft maneuvering controller 50 repeatedly performs this process in a predetermined control cycle. If the watercraft maneuvering controller 50 receives the overboard information from the communication unit 60 to detect the overboard event (YES in Step S21), the watercraft maneuvering controller 50 performs a propulsive force nullifying control operation to nullify the propulsive forces of all the outboard motors 1 (Step S22). In the propulsive force nullifying control operation, the generation of the propulsive forces of all the outboard motors 1 is stopped. In the propulsive force nullifying control operation, specifically, the engines 11 of all the outboard motors 1 may be stopped. In the propulsive force nullifying control operation, the shift positions of all the outboard motors 1 may be changed to the neutral shift positions.

If the overboard event is not detected (NO in Step S21), the watercraft maneuvering controller 50 does not perform the propulsive force nullifying control operation but performs an operation state maintaining control operation to be described below (Step S23). If the overboard event is detected (YES in Step S21), the watercraft maneuvering controller 50 does not perform the operation state maintaining control operation (Step S23) but performs the propulsive force nullifying control operation (Step S22).

As described above, the watercraft 100 includes a mechanical lanyard system including the lanyard switch 39 and the lanyard cable 40. If the mechanical lanyard system is properly utilized when the operator falls overboard, the propulsive forces of the outboard motors 1 are immediately nullified by the action of the mechanical lanyard system. Even if the operator happens to forget to connect himself to the lanyard cable 40, the propulsive force nullifying control operation is performed according to the process shown in FIG. 7.

Figure 8:
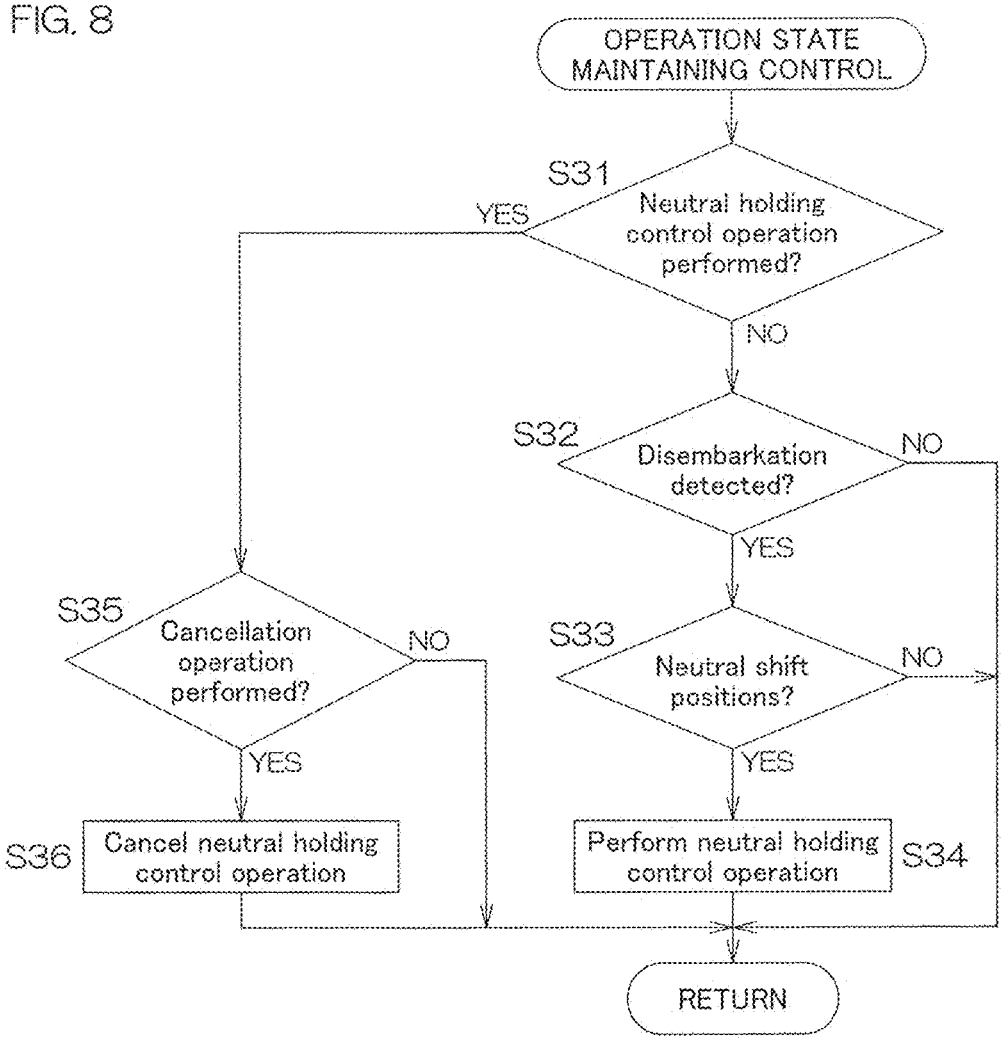
FIG. 8 is a flowchart showing an operation state maintaining control operation by way of example.

FIG. 8 is a flowchart showing the operation state maintaining control operation by way of example. In the operation state maintaining control operation, the outboard motors 1 are maintained in a propulsive force non-generation state when the operator is spaced away from the watercraft 100 irrespective of the operation of the operation elements provided in the watercraft maneuvering station ST (specifically, irrespective of the operation of the acceleration levers 33 or the joystick 36). In the present preferred embodiment, the outboard motors 1 are maintained in the propulsive force non-generation state if a predetermined operation state maintaining condition is satisfied when it is detected that the operator carrying the operator fob Fo has disembarked from the watercraft 100. In the present preferred embodiment, more specifically, the operation state maintaining condition includes a condition such that the outboard motors 1 are in the propulsive force non-generation state, more specifically a condition such that the shift positions of the outboard motors 1 are the neutral shift positions and the power transmission paths from the engines 11 to the propellers 13 are each in the disengaged state. Therefore, if the disembarkation of the operator is detected when the shift positions are the neutral shift positions, the neutral holding control operation (an example of the operation state maintaining control operation) is performed to hold the shift positions in the neutral shift positions. During the neutral holding control operation, the watercraft maneuvering controller 50 holds the shift positions in the neutral shift positions without response to the operation of the acceleration levers 33 and the joystick 36 so that the outboard motors 1 generate no propulsive forces.

Referring to FIG. 8, more specifically, the watercraft maneuvering controller 50 determines whether or not the neutral holding control operation is performed (Step S31). If the neutral holding control operation is performed (YES in Step S31), the watercraft maneuvering controller 50 determines whether or not a cancellation operation is performed (Step S35). Specifically, the cancellation operation is performed to cancel the neutral holding control operation by operating the neutral hold buttons 34. If the cancellation operation is performed (YES in Step S35), the watercraft maneuvering controller 50 cancels the neutral holding control operation (Step S36). Thus, the watercraft maneuvering controller 50 resumes its ordinary control state to generate the propulsive forces from the outboard motors 1 in response to the operation of the acceleration levers 33 and the joystick 36.

If the neutral holding control operation is not performed (NO in Step S31), the watercraft maneuvering controller 50 determines whether or not the disembarkation information is received from the communication unit 60, i.e., whether or not the disembarkation of the operator is detected (Step S32). If the disembarkation of the operator is not detected (NO in Step S32), the process returns without performing the neutral holding control operation (Step S34).

If the disembarkation of the operator is detected (YES in Step S32), the watercraft maneuvering controller 50 checks whether or not the current shift positions are the neutral shift positions (Step S33). For example, the watercraft maneuvering controller 50 is able to acquire information of the current shift positions of the outboard motors 1 from the propulsion system controller 55. Based on the information, the watercraft maneuvering controller 50 is able to determine whether or not the current shift positions are the neutral shift positions. If the current shift positions are not the neutral shift positions (NO in Step S33), the watercraft maneuvering controller 50 returns without performing the neutral holding control operation (Step S34). If the current shift positions are the neutral shift positions (YES in Step S33), the watercraft maneuvering controller 50 performs the neutral holding control operation (Step S34). That is, when the disembarkation of the operator is detected, the watercraft maneuvering controller 50 performs the neutral holding control operation on condition that the control mode is the ordinary mode and the shift positions are the neutral shift positions.

As described above, the watercraft 100 includes the mechanical lanyard system including the lanyard switch 39 and the lanyard cable 40. If the mechanical lanyard system is properly utilized when the operator leaves the watercraft 100, the propulsive forces of the outboard motors 1 are immediately nullified by the action of the mechanical lanyard system. Even if the operator happens to forget to connect himself to the lanyard cable 40, the shift positions are held in the neutral shift positions according to the process shown in FIG. 8 such that the propulsive forces are prevented from being accidentally generated through operation by a person other than the operator.

According to a preferred embodiment, as described above, the communication unit 60 provides the disembarkation information to the watercraft maneuvering controller 50 if it is detected that the operator carrying the operator fob Fo has disembarked from the watercraft 100. Upon reception of the disembarkation information, the watercraft maneuvering controller 50 performs the operation state maintaining control operation (neutral holding control operation) to hold the shift positions of the outboard motors 1 in the neutral shift positions irrespective of the operation of the acceleration levers 33 and the joystick 36. That is, the outboard motors 1 are automatically brought into the neutral shift position holding state without the need for the operation of the neutral hold buttons 34. Thus, the operation of the acceleration levers 33 and the joystick 36 by an occupant (typically, a passenger) not carrying the operator fob Fo is disabled, so that the operator carrying the operator fob Fo is able to properly manage the operation states of the outboard motors 1.

In a preferred embodiment, if the disembarkation of the operator is detected, the watercraft maneuvering controller 50 determines whether or not the predetermined operation state maintaining condition is satisfied. If the operation state maintaining condition is satisfied, the watercraft maneuvering controller 50 performs the neutral holding control operation. If the operation state maintaining condition is not satisfied, the watercraft maneuvering controller 50 does not perform the neutral holding control operation.

In a preferred embodiment, the operation state maintaining condition includes the condition such that the shift positions are the neutral shift positions, i.e., the condition such that the outboard motors 1 are in the propulsive force non-generation state. Therefore, the shift positions of the outboard motors 1 are held in the neutral shift positions, even if an occupant not carrying the operator fob Fo operates the acceleration levers 33 or the joystick 36 when the operator is spaced away from the watercraft 100 with the shift positions set in the neutral shift positions. Thus, the outboard motors 1 are maintained in the propulsive force non-generation state. Thus, the generation of the propulsive forces by the outboard motors 1 is properly managed by the operator carrying the operator fob Fo.

The operation state maintaining condition is not necessarily required to be such that the shift positions are the neutral shift positions. Without determining whether or not the operation state maintaining condition is satisfied, the neutral holding control operation may be performed upon the detection of the disembarkation of the operator. However, a situation such that the operator leaves the watercraft 100 with the shift positions set in the forward shift positions or in the reverse shift positions, i.e., with the outboard motors 1 kept in a shift-in state, is unexpected if the operator sufficiently carefully maneuvers the watercraft 100. Therefore, the neutral holding control operation is preferably performed only when the shift positions are the neutral shift positions.

In a preferred embodiment, the communication unit 60 which wirelessly communicates with the operator fob Fo functions as the disembarkation sensor, and detects whether or not the operator has disembarked from the watercraft 100 based on the state of the communications with the operator fob Fo. There is no physical connection between the operator fob Fo and the watercraft maneuvering station ST, so that the operator is able to disembark from the watercraft 100 while carrying the operator fob Fo. Even if the operator forgets to connect himself to the lanyard cable 40, the operator is able to properly manage the operation states of the outboard motors 1.

In a preferred embodiment, the communication unit 60 which wirelessly communicates with the fobs F functions as the overboard sensor. The communication unit 60 detects the occupant overboard event based on the states of the communications with the fobs F. The communication unit 60 is able to distinguish between the disembarkation of the operator and the operator overboard event based on the state of the communications with the operator fob Fo. Specifically, as described above, the communication unit 60 is able to distinguish between the disembarkation and the overboard event by utilizing different radio signals for the detection of the disembarkation and for the detection of the overboard event. Further, as described above, the communication unit 60 is able to distinguish between the disembarkation and the overboard event by utilizing a common radio signal for the detection of the disembarkation and for the detection of the overboard event and monitoring a change in the reception intensity of the radio signal. Typically, the overboard event may be detected if the communication unit 60 does not receive the radio signal from the operator fob Fo, and the disembarkation may be detected if the communication unit 60 receives the radio signal but the intensity of the radio signal is low. Thus, the communication unit 60 is able to double as the disembarkation sensor and the overboard sensor.

If the operator overboard information is provided, the watercraft maneuvering controller 50 performs the propulsive force nullifying control operation to nullify the propulsive forces of the outboard motors 1 irrespective of the operation states of the outboard motors 1 without performing the operation state maintaining control operation (neutral holding control operation). Therefore, if the operator overboard event occurs, the outboard motors 1 are brought into the propulsive force non-generation state, thus preventing the watercraft 100 from moving away from the overboard operator by the generation of the propulsive forces.

In a preferred embodiment, the neutral holding control operation is cancelled if the neutral hold buttons 34 are operated during the neutral holding control operation. Thus, an occupant not carrying the operator fob Fo is permitted to perform the watercraft maneuvering operation as required.

Therefore, the watercraft maneuvering system 102 permits the occupant other than the operator to perform the watercraft maneuvering operation as required while allowing the operator to properly manage the operation states of the outboard motors 1.

While preferred embodiments of the present invention have thus been described above, the present invention may be embodied in some other ways as will be described below by way of example.

In a preferred embodiment described above, the outboard motors 1 each including the engine as a prime mover are used as the propulsion systems, but propulsion systems of different structure may be used. For example, electric propulsion systems each including an electric motor as the prime mover may be used as the propulsion systems. Besides the outboard motors 1, the propulsion systems may be inboard motors, inboard/outboard motors, jet propulsion systems, or any other propulsion systems. In the electric propulsion systems, the nullification of the propulsive forces is typically achieved by stopping the electric motors.

In a preferred embodiment described above, the two propulsion systems (two outboard motors 1) are provided on the stern 2 by way of example, but the number and the positions of the propulsion systems are not limited to those. Alternatively, a single propulsion system or three or more propulsion systems may be provided on the stern 2. Further, a bow thruster may be provided around the bow.

In a preferred embodiment described above, the disembarkation of the operator from the watercraft 100 is detected by utilizing the communications between the operator fob Fo and the communication unit 60, but the disembarkation sensor that detects the disembarkation of the operator may be configured so as not to utilize the operator fob Fo. For example, a camera that monitors the operator may be provided in the watercraft maneuvering station ST so that the disembarkation of the operator is able to be detected based on an image captured by the camera. Further, a seating sensor to detect the operator seating on the driver seat 30 may be used as the disembarkation sensor. Examples of the seating sensor include a load sensor and an infrared sensor.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft maneuvering system comprising:

an operator fob usable by an operator of a watercraft;

a watercraft maneuvering input on the watercraft operable by the operator so as to command generation of a propulsive force;

a controller provided on the watercraft and configured or programmed to control operation of a propulsion system of the watercraft according to the operation of the watercraft maneuvering input;

an overboard sensor to detect an operator overboard event when the operator falls overboard from the watercraft; and a disembarkation sensor to detect disembarkation of the operator carrying the operator fob from the watercraft other than the operator overboard event; wherein the controller is configured or programmed to perform an operation state maintaining control operation to maintain the propulsion system in a propulsive force non-generation state when the disembarkation sensor detects that the operator carrying the operator fob has disembarked from the watercraft irrespective of the operation of the watercraft maneuvering input; and when the overboard sensor detects the operator overboard event, the controller is configured or programmed not to perform the operation state maintaining control operation but to perform a propulsive force nullifying control operation to nullify the propulsive force of the propulsion system.

2. The watercraft maneuvering system according to claim 1, wherein the propulsion system includes an engine, a propeller to be driven by the engine, and a clutch provided in a power transmission path between the engine and the propeller; and the propulsive force non-generation state of the propulsion system includes an operation state in which the clutch is in a disengaged state.

3. The watercraft maneuvering system according to claim 2, wherein the controller is configured or programmed to perform the operation state maintaining control operation if the disembarkation sensor detects that the operator carrying the operator fob has disembarked from the watercraft when the engine is in operation and the clutch is in the disengaged state.

4. The watercraft maneuvering system according to claim 1, wherein the disembarkation sensor includes a communicator to wirelessly communicate with the operator fob, and to detect whether or not the operator has disembarked from the watercraft based on a state of communication between the communicator and the operator fob.

5. The watercraft maneuvering system according to claim 1, wherein the disembarkation sensor and the overboard sensor share a communicator to wirelessly communicate with the operator fob, and are operable to distinguish between the operator overboard event and the disembarkation of the operator from the watercraft based on a state of communication between the communicator and the operator fob.

6. The watercraft maneuvering system according to claim 1, further comprising a cancellation switch to cancel the operation state maintaining control operation.

7. A watercraft maneuvering system comprising:

a watercraft maneuvering input on a watercraft and operable by an operator of the watercraft to command generation of a propulsive force;

a controller provided on the watercraft and configured or programmed to control operation of a propulsion system of the watercraft according to an operation of the watercraft maneuvering input;

an overboard sensor to detect an operator overboard event when the operator falls overboard from the watercraft; and a disembarkation sensor to detect disembarkation of the operator from the watercraft other than the operator overboard event; wherein the controller is configured or programmed to perform an operation state maintaining control operation to maintain the propulsion system in a propulsive force non-generation state when the disembarkation sensor detects that the operator has disembarked from the watercraft irrespective of the operation of the watercraft maneuvering input; and when the overboard sensor detects the operator overboard event, the controller is configured or programmed not to perform the operation state maintaining control operation but to perform a propulsive force nullifying control operation to nullify the propulsive force of the propulsion system.

8. A watercraft comprising:

a hull;

a propulsion system provided on the hull; and the watercraft maneuvering system according to claim 1.

9. A watercraft comprising:

a hull;

a propulsion system provided on the hull; and the watercraft maneuvering system according to claim 7.

* * * * *